US006026706A

United States Patent [19]

Güther et al.

[11] Patent Number: 6,026,706

[45] Date of Patent: Feb. 22, 2000

[54] LOCKING ARRANGEMENT FOR CRASH-PROOF ACTUATOR

[75] Inventors: Jürgen Güther, Frankfurt; Bernhard Jeuck, Dornburg, both of Germany

[73] Assignee: ITT Manufacturing Enterprises Inc., Wilmington, Del.

[21] Appl. No.: 09/091,205

[22] PCT Filed: Oct. 4, 1997

[86] PCT No.: PCT/EP97/05452

§ 371 Date: Jun. 10, 1998

§ 102(e) Date: Jun. 10, 1998

[87] PCT Pub. No.: WO98/16404

PCT Pub. Date: Apr. 23, 1998

[30] Foreign Application Priority Data

Oct. 12, 1996 [DE] Germany ..... 196 42 123

[51] Int. Cl.[7] ..... G05G 1/14

[52] U.S. Cl. ..... 74/512; 74/560

[58] Field of Search ..... 74/512, 513, 560; 180/274, 275, 335

[56] References Cited

U.S. PATENT DOCUMENTS

| | | | |
|---|---|---|---|
| 3,052,130 | 9/1962 | Kellogg et al. | 74/512 X |
| 3,766,802 | 10/1973 | Shellhause | 74/512 |
| 4,655,628 | 4/1987 | Parker | 74/512 X |
| 4,899,614 | 2/1990 | Kataumi . | |
| 5,551,317 | 9/1996 | Gautier et al. | 74/512 X |

FOREIGN PATENT DOCUMENTS

| | | | |
|---|---|---|---|
| 229350 | 7/1987 | European Pat. Off. | 74/512 |
| 3733975 | 1/1989 | Germany . | |
| 4112132 | 10/1991 | Germany . | |
| 4112133 | 10/1991 | Germany . | |
| 4409235 | 10/1994 | Germany . | |
| 2244324 | 11/1991 | United Kingdom | 74/512 |

*Primary Examiner*—Mary Ann Battista
*Attorney, Agent, or Firm*—Rader, Fishman & Grauer PLLC

[57] ABSTRACT

A locking sleeve for locking a rotary connection between the actuating bar of a brake system and a pedal lever is releasable in the event of crash. To permit, during assembly, a fast and safe locking engagement even under poor visual conditions, the locking device is supplied in pre-assembled condition, preferably, on the actuating bar. Advantageous embodiments relate to features insuring a reliable engagement in that bias forces release the connection in the event that the locking position has not been completely achieved.

10 Claims, 9 Drawing Sheets

Fig. 1
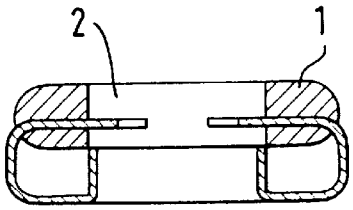
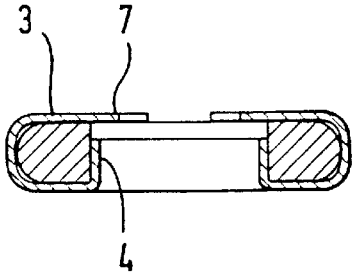
Fig. 2
Fig. 3
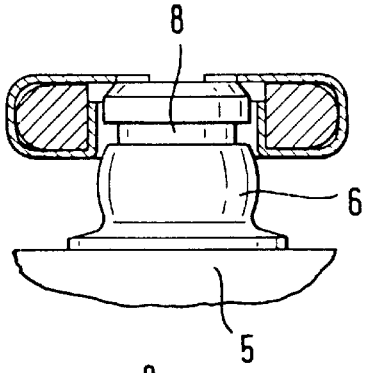
Fig. 4
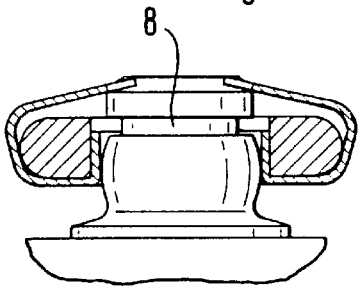
Fig. 5
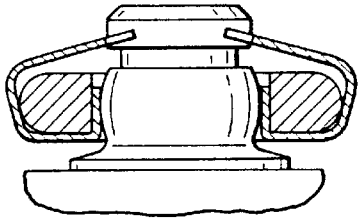
Fig. 6
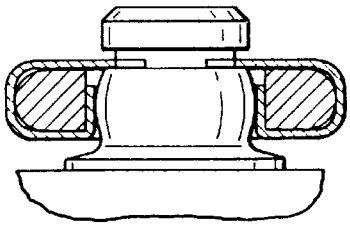

Fig. 7
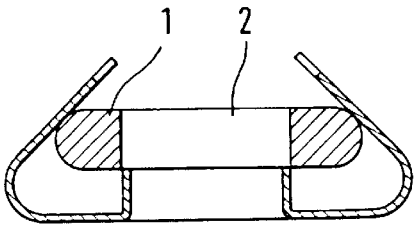
Fig. 9
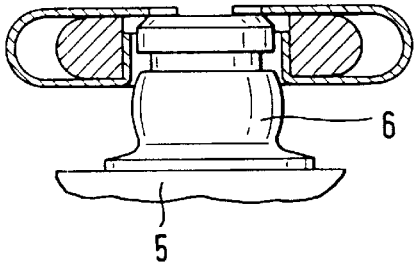
Fig. 10
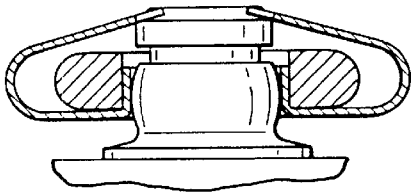
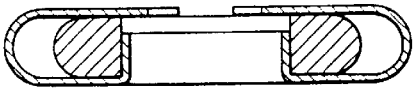
Fig. 8
Fig. 11
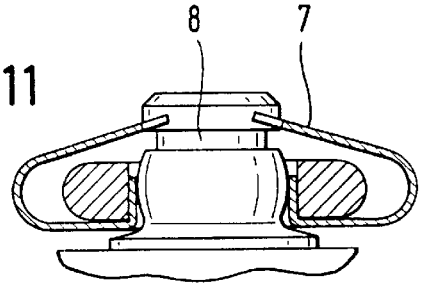
Fig. 12
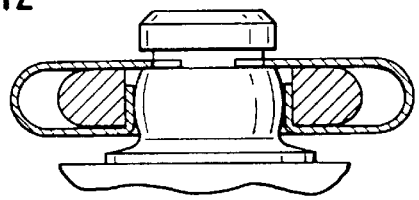

10
13
11

11
2
F
1

15
6
8
5
14

12
1

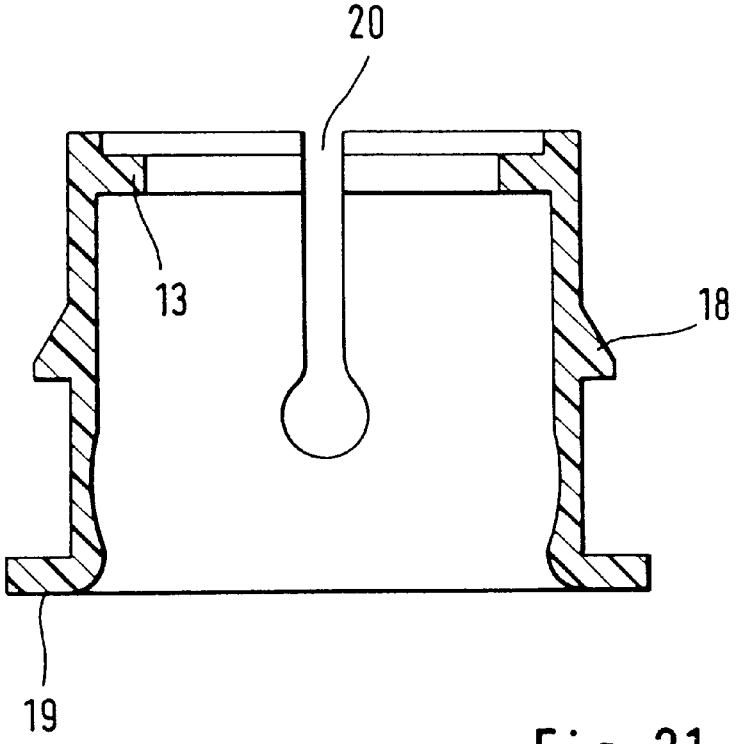
Fig. 21
Fig. 22
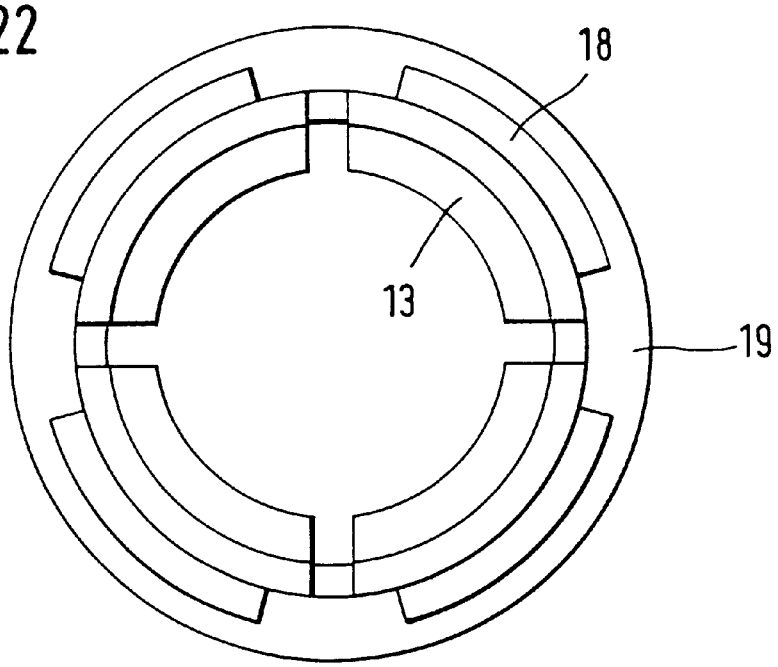

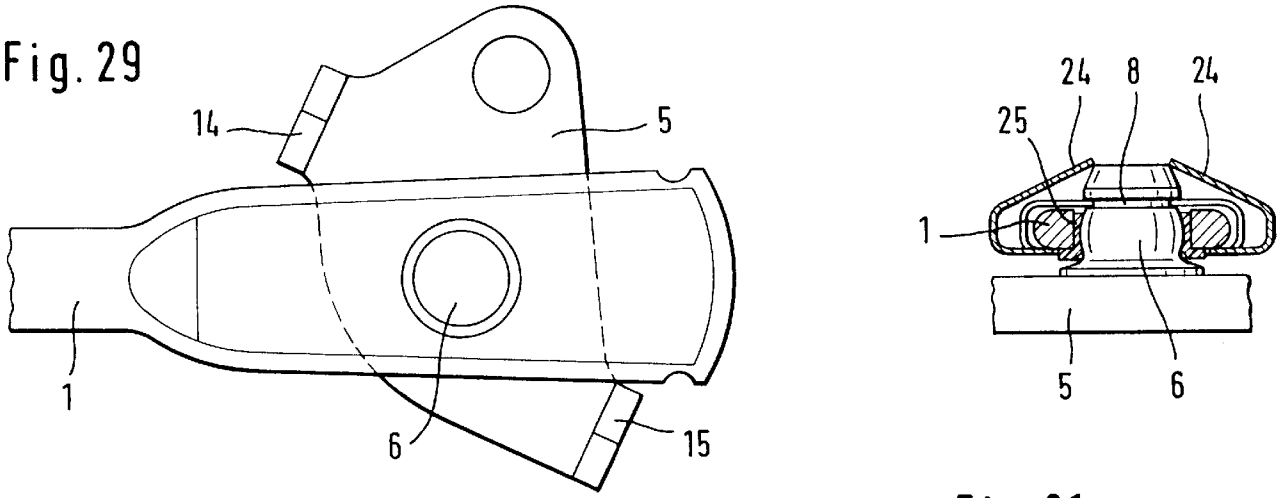
Fig. 29
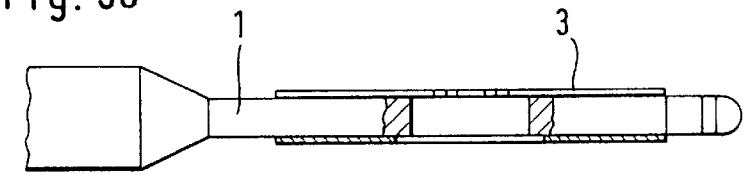
Fig. 30
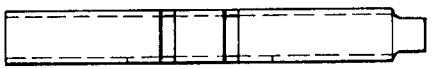
Fig. 31
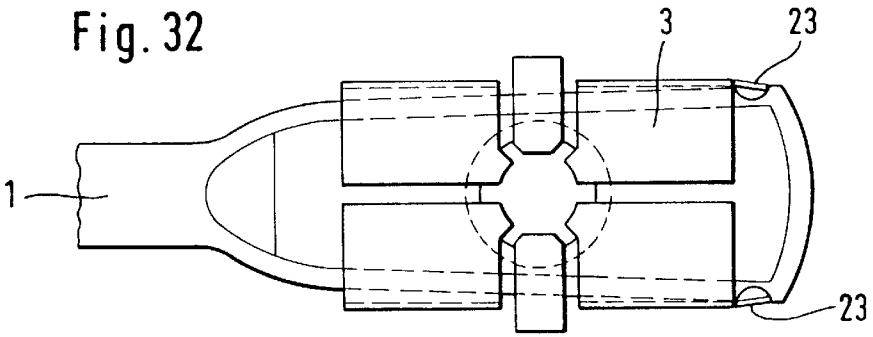
Fig. 32
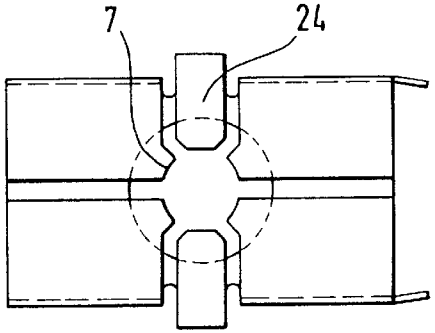
Fig. 33
Fig. 34

24
24
23
21

23
22
22

24
5
24

LOCKING ARRANGEMENT FOR CRASH-PROOF ACTUATOR

BACKGROUND OF THE INVENTION

Brake systems are actuated, as are clutches, by pedal force with the aid of a pedal system, with the driver, for actuating the brake system, swivelling a pedal lever, thereby inserting an actuating bar into a brake system thus releasing the braking process. Pedal systems of the afore-described type have a large transmission so that a minor displacement of the actuating bar taking place in an axial longitudinal direction corresponds to a substantial angle of displacement of the pedal lever. As in a crash event, the brake units, such as master cylinder or brake force booster, can be substantially displaced, dangerous motions of displacement of the pedal lever are likely to occur. Due to the lever deflection, the driver's foot can, therefore, either be clamped against the baffle plate or guided, due to an uncontrolled deflection, into the bottom area of the vehicle which is rather narrow anyway. A deflection of the afore-described type is dangerous, especially so if the driver due to the impact anyway slips to the front end of the passenger compartment.

It has, therefore, been thought over how to avoid such a swivel movement of the pedal lever in a crash event. According to one suggestion the fact is utilized that in a crash event the actuating bar will cover a particularly large swivel angle vis-a-via the pedal lever. This fact is used to discontinue the connection between actuating bar and pedal lever in that the actuating bar is pushed out of the rotary bearing on the pedal lever, it being suggested to enable the actuating bar to be pushed laterally of the bearing bolt once a predetermined swivel angle is exceeded. To achieve this, the bearing bore of the actuating bar, laterally, is to be provided with an opening of a size sufficient to allow the bearing bolt of the pedal lever to pass the said opening under force.

According to another suggestion the rotary movement of the actuating bar is used to lift the actuating bar from the rotary bearing in a direction axial to the bearing bolt in that a force acting in that direction overcomes the bolt lock.

The conventional locking means encouter the difficulty that, under poor visual conditions, they have to be rapidly and safely mounted in the bottom part of the passenger compartment. An additional disadvantage involved with the state-of-the art systems resides in that one can never tell whether the locking means are really reliably locked.

OBJECT OF THE INVENTION

It is, therefore, the object of the invention to provide locking means with a system of the afore-described type, that are capable of being rapidly and safely mounted even under poor visual conditions. Basically, it is the object of the invention to avoid threading of the locking means on the actuating bar or bolt of the pedal lever by supplying the locking means pre-assembled (preferably on the actuating bar) prior to manufacturing the articulated joint.

SUMMARY OF THE INVENTION

This object is achieved by a locking device which is provided with a holding element holding the locking device before locking on the actuating bar or the actuating pedal. Frequently, it is important for the locking means not only to be rapidly arranged, under poor visual conditions, at the proper place but also to be perfectly engaged. To achieve this object the invention suggests providing spring elements on the locking means acting in opposition to the force required for the locking connection, with the said spring forces being so dimensioned that, in the event of an incomplete engagement, they lift the locking arrangement out of the incomplete locking connection, thereby causing the locking arrangement to abut the locking bolt only loosely. Only after a complete locking connection having been achieved, the spring forces cannot separate the said connection. At the same time, the spring elements can result in a snap effect insuring that the locking device be pressed, with adequate force, onto the bolt provided with locking means. If the force selected is insufficient, the locking position cannot be reached so that the locking device is automatically forced out of the locking position. The spring elements can force out the locking device by engaging the surface of the actuating bar or they can withdraw therefrom by engaging the bolt head.

A particularly simple way of pre-assembling the locking means on the actuating bar is suggested by a locking device embracing the actuating bar in a collar-type way, it being possible to provide additional locking means holding the locking device on a predetermined point of the actuating bar in that resilient tangs abut the surface of the actuating bar to engage suitable recesses located there.

A very simple way of locking the locking device on the bolt is provided by a feature according to which the locking device with the locking means thereof are pushed across the bolt and deflected during that movement by an adequate amount to virtually engage a circumferential groove of the bolt.

A particularly simple construction of the locking device of the invention is provided for if the locking device is integrally punched from sheet metal to be subsequently shaped accordingly. A preferred form is constituted by a collar embracing the actuating bar. The locking device, in addition, can be provided with a holding arm which, through a resilient claw, engages the actuating bar thereby holding the holding mechanism in a suitable position on the actuating bar.

To avoid that the locking device be mounted in a left-and-right reversed way or that the actuating bar provided with the pre-assembled locking device be locked onto the bolt in a manner left-and-right reversed, it is suggested to use a locking device including fingers substantially projecting at right angles from the surface of the device, which fingers are of a length not permitting locking engagement in an incorrect assembly position wherein the fingers point to the surface of the actuating bar. The fingers prevent the left-and-right-reversed locking device from being plugged onto the bolt by holding the locking means at a space from the bolt.

As for improving the properties of the rotary bearing, a bearing sleeve is anyway plugged onto the bolt that fills the space between the inner faces of the opening within the actuating bar and the outer cylindrical surface of the bolt. Preferably, a plastic sleeve is pre-assembled within the opening of the actuating bar which not only has locking means opposite the bolt but at the same time also improves the racing properties of the actuating bar over the bolt on the pedal lever.

Various embodiments of the invention will now be described in closer detail with reference to the drawing.

BRIEF DESCRIPTION OF THE DRAWINGS

In the drawings,

FIGS. 1 and 2 show the pre-assembly of a first embodiment of a locking device on an actuating bar;

FIGS. 3 to 6 show the actuating bar according to FIG. 1 in engagement with a bolt on the pedal lever;

FIGS. 7 and 8 show a pre-assembly according to FIGS. 1 and 2 in accordance with a second embodiment;

FIGS. 9 to 12 show an actuating bar in the locked position in accordance with the embodiment of FIGS. 7 and 8;

FIGS. 17 to 22 show the end-use application of a fourth embodiment;

FIGS. 23 to 34 show the embodiment of a fifth embodiment of the invention.

DETAILED DESCRIPTION OF THE INVENTION

Figures 13, 14, 15, 16:
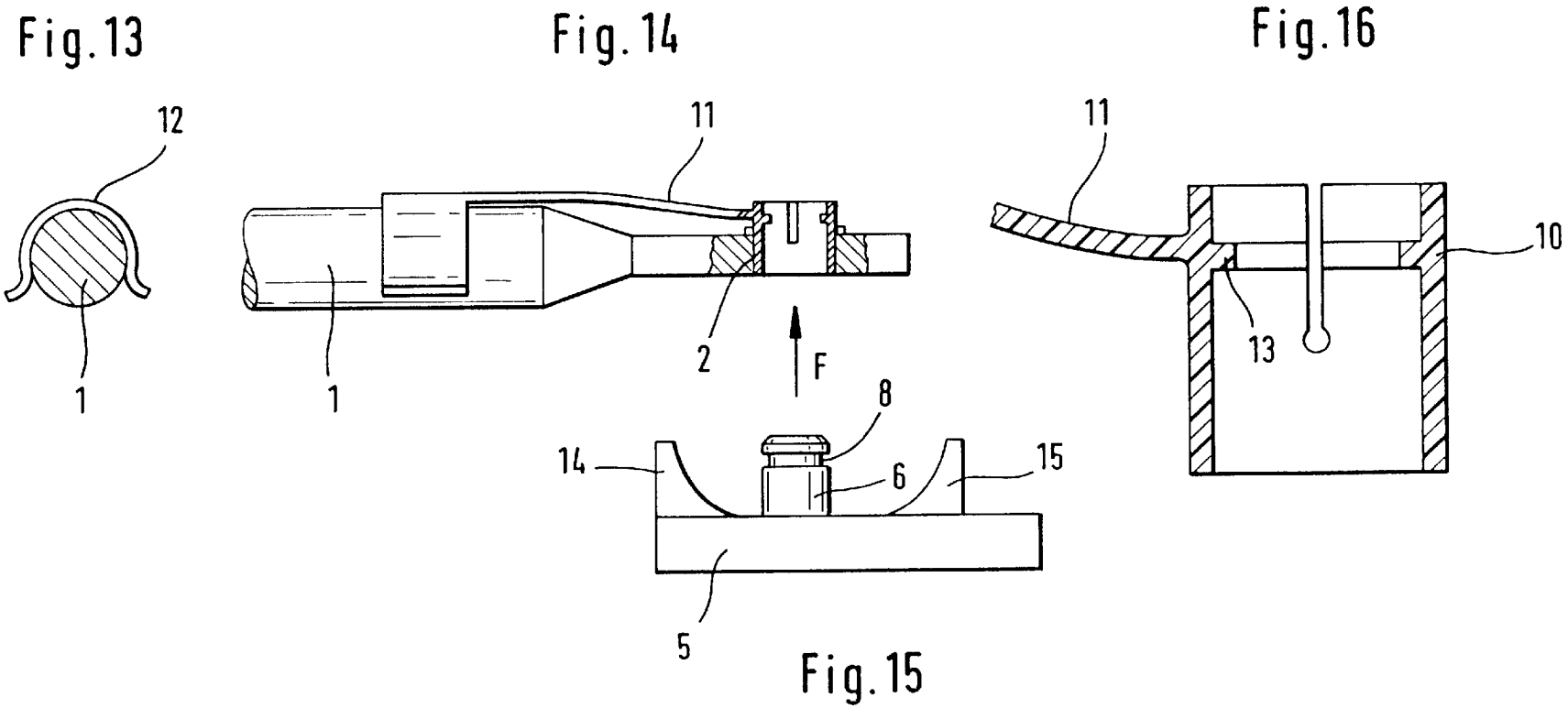
FIGS. 13 to 16 show the end-use application of a third embodiment.

A possible connection between an actuating bar and the pedal lever has been described, for example, in DE-OS 40 13 284. As opposed to that state of art, wherein a fork located on one end of the actuating bar is pivotally arranged by means of an opening within the fork and a bolt traversing the brake pedal, the present invention is based on the fact that—in accordance with FIGS. 3 through 6—the actuating bar provided with an opening is plugged onto a bolt projecting from the brake pedal and is locked therewith. FIG. 1 shows a cross-sectional view of an actuating bar 1 having a continuous opening 2. Plugged onto the said actuating bar is a locking device 3 corresponding in shape to the pre-assembly. The locking device, in plan view, approximately can have the appearance as shown in FIGS. 23,24 or 37,38. The locking mechanism substantially can be made of a sheet metal collar extending with locking projections into the interior of a passage hole provided in the collar. As conveyed by FIG. 2, tongues 4 engage the inner walls of the opening 2 of the actuating bar 1. The pre-assembled unit according to FIG. 2 is plugged onto a bolt 6 projecting from the pedal lever 5 and is forcibly depressed until the locking projections 7 engage the circumferential groove 8 of the bolt 6. FIGS. 7 through 12 show a corresponding process with the exception that the locking device 3 in that instance is of a larger width so that the locking projections are of greater length thus having a more flexible behavior. FIGS. 3 through 6 and 9 through 12, respectively, show the individual steps of the locking process.

FIG. 16 shows a cut-out of a locking sleeve inserted into a passage hole 2 of the actuating bar 1. The actuating bar itself can have the shaping shown in FIGS. 29 through 32 so that across its substantial length it is of a cylindrical configuration and at the end accommodating the opening 2 is of a square shaping. The plastic sleeve 10, via a holding arm 11, is in communication with the actuating bar 1, with a spring claw 12 resiliently engaging one end of the holding arm 11, thereby fixing the position of the plastic sleeve 10 vis-a-via the actuating bar 1, with the plastic sleeve 10 being supplied pre-assembled with the actuating bar 1. In addition, the plastic sleeve 10 includes radially projecting locking projections 13 engaging the circumferential groove 8 of the bolt 6. At the same time, FIG. 15 shows two ramps the oblige wedge-type faces of which insure that during a rotary movement of the actuating bar 1 exceeding a predetermined rotary angle vis-B-vis the pedal lever 5, the bar is removed from the bolt 6 in the direction of arrow F, thereby achieving, in a crash event, the forceful discontinuation of the bearing connection between bolt 6 and actuating bar 1.

Figure 17:
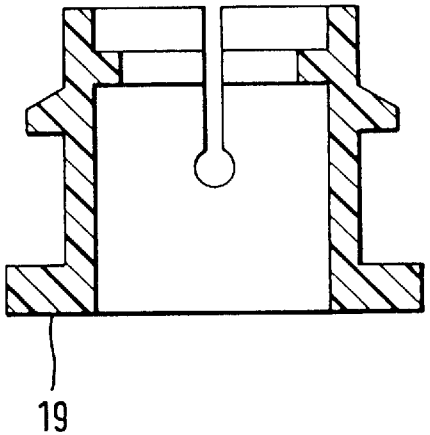
Figure 18:
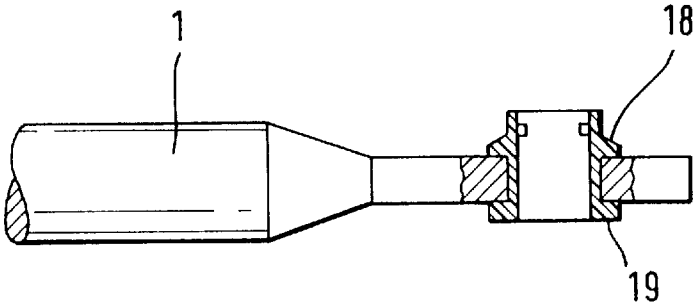
Figure 19:
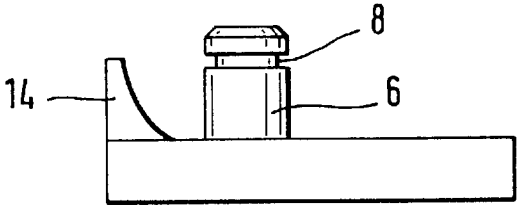
Figure 20:
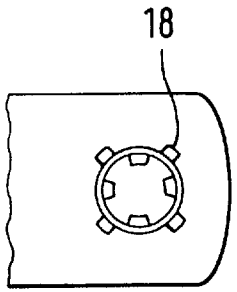
Figure 28:
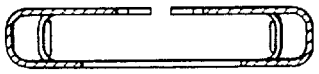
Figure 27:
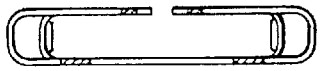
Figure 24:
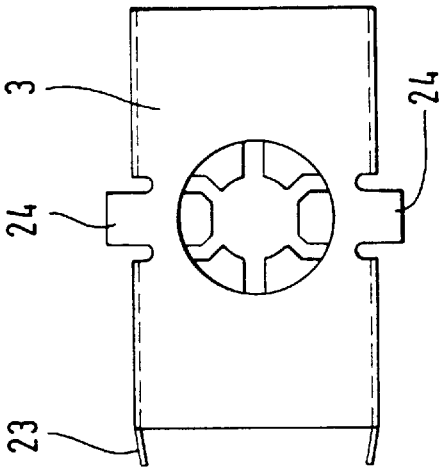
Figure 26:
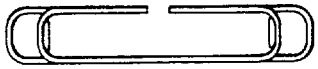
Figure 25:
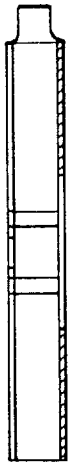
Figure 23:
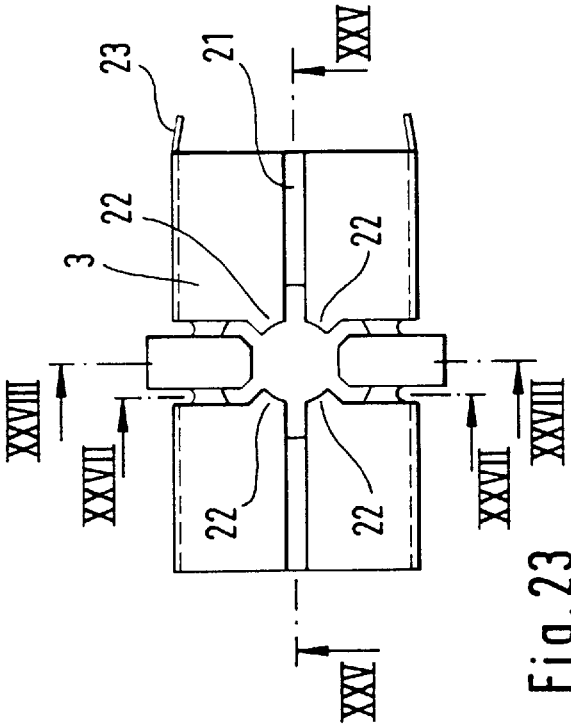

FIGS. 17 through 19 show a fourth form of embodiment of the invention slightly modified over the afore-described plastic sleeve, with the sleeve other than in FIG. 11, not being held through a holding arm 11 in pre-assembled on the actuating bar 1, but rather through flexible holding fingers 18,19 engaging the surface of the actuating bar 1. The plastic sleeve 19 in FIG. 18, for pre-assembly purposes, is impressed from bottom to top until it takes the position as shown in FIG. 18. FIG. 20 is a plan view of a cut-out of FIG. 17. FIG. 19 distinguishes from FIG. 15 only in that one ramp 14 is provided rather than two. According to FIGS. 21 and 22 the plastic sleeve of FIGS. 18,20 is shown in greater detail. By providing the slots 20, an improved resilient effect is achieved as regards the holding fingers 18 and the locking projections 13. Whereas the forms of embodiment of the locking device according to FIGS. 13 through 22 are made of plastic material, FIGS. 25 through 34 show a fifth form of embodiment made of sheet metal, with the locking device substantially comprising a collar of sheet metal slotted on one side thereof (see FIG. 23). While FIG. 23 shows the upper surface of the locking collar, FIG. 24 shows the surface of the bottom side facing the actuating bar. FIGS. 26,27,28 are sectional views of the collars at the points identified. It is important for the invention that the longitudinal slot 21 anyway required for the manufacture from a single sheet metal portion, at the same time insures the flexibility of the locking projections 22 intended to engage the circumferential groove 8 of the bolt 6. FIGS. 26 through 28 are sectional views of the collar-shaped locking device at the points identified. Also, it is important for the invention that provided on at least two sides of the locking device 3 are resilient spring tangs 23 capable to engage corresponding recesses on the lateral faces of the actuating bar 1, thereby locking the position vis-a-via the actuating bar 1 as clearly conveyed by FIG. 32. Moreover, the spring elements 24 are important for the invention; starting from the bottom (FIG. 26) of the locking device, they are comparatively long, extending into the area of the locking projections 22 on the upper side of the locking device 3 according to FIG. 23. The said spring elements 24 not only serve for insuring an engagement but also for creating a bias effect pulling down the locking device from the bolt 6 in case of an incomplete engagement. Hence, the spring elements insure a permanent bias toward disengagement. At the same time, rattling of the locking sleeve and of the rotary bearing can be prevented from occurring due to the bias effect clearly shown in FIG. 34 while FIGS. 30 and 32 show the locking device 3 in pre-assembled condition on the actuating bar 1.

FIG. 34, additionally, shows the use of a bearing sleeve 25 for improving the rotary bearing provided between the actuating bar 1 and the bolt 6.

Figures 35, 36, 37, 38, 39:
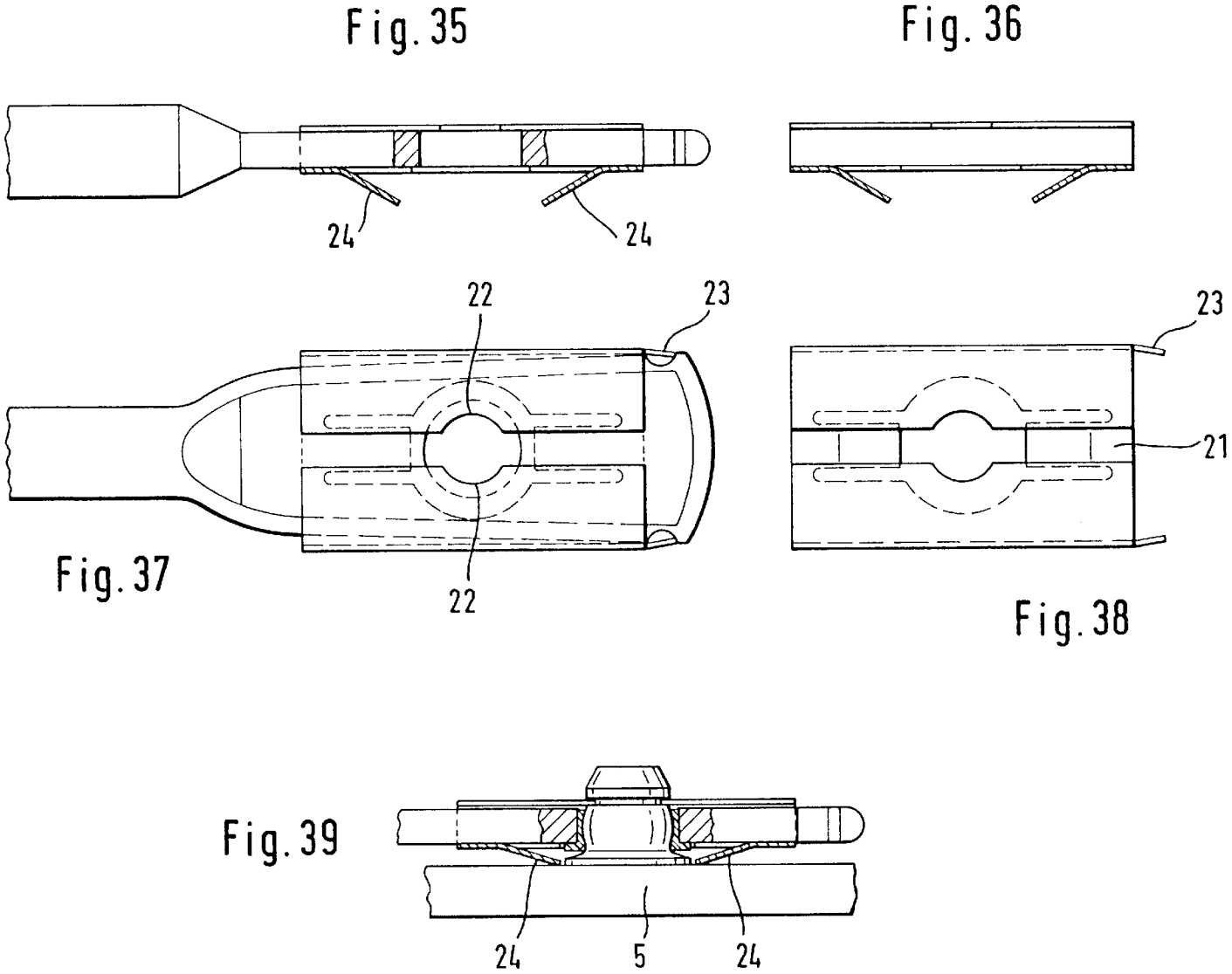
FIGS. 35 to 43 show a sixth embodiment.
Figure 43:
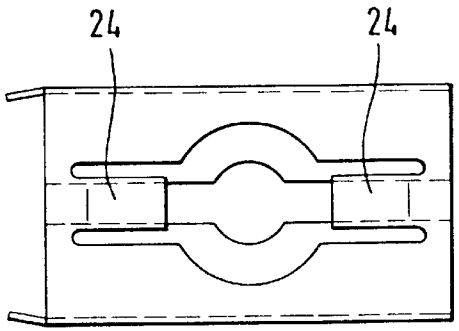
Figure 42:
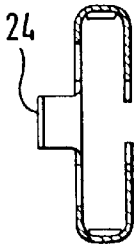
Figure 41:
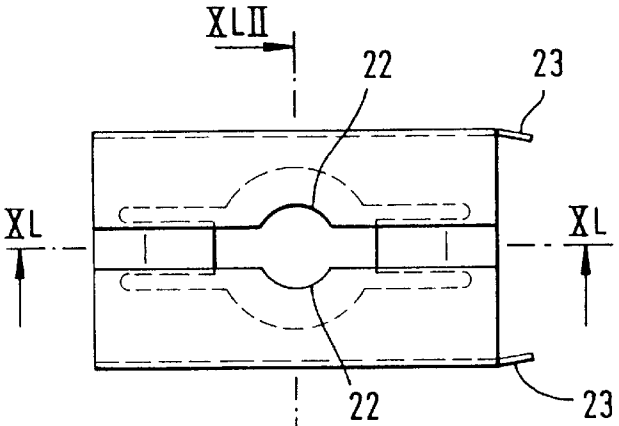
Figure 40:
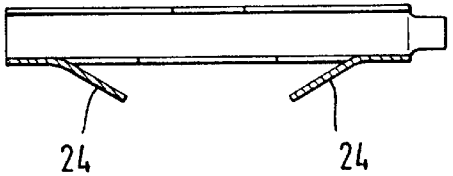

FIGS. 35 through 43 show a modified form of embodiment of the locking device according to FIGS. 23 through 34. An essential difference of the sixth form of embodiment from the afore-mentioned fifth embodiment resides in the arrangement of the spring elements 24 which—as shown in FIG. 39—are trying to force the locking device 3 through abutment against the surface of the pedal lever 5 out of the locking engagement. Also, a slight modification has occurred as regards the locking projections 22, namely, in lieu of four locking projections provided according to FIGS. 22 through 34 only two locking projections 22 of a reduced elasticity have been provided in this embodiment, that follow the longitudinal slot 21.

FIG. 29, additionally, shows the principle of discontinuing the rotary connection in a crash event. Ramps 14,15 are shown in plan view, insuring that when further turning the actuating bar 1 in clockwise direction, the actuating bar 1 is withdrawn from the bolt 6 toward the viewer.

We claim:

1. An arrangement for actuating a mechanism of a brake system for an automotive vehicle, comprising a swivably arranged pedal lever having a bolt connected thereto;

an actuator bar defining an opening therethrough for receiving the bolt;

a locking device releasably coupling the actuator bar and the bolt together, the locking device comprising a planar body defining an open center portion for receiving the bolt;

a first pair of radially positioned, opposing projections supported by the planar body, wherein one end of each projection is bent to extend axially along the opening of the actuator bar; and a second pair of opposing projections extending laterally from the planar body, wherein one end of each projection forming the second pair of opposing projections engages the bolt, whereby the locking device joins the bolt and the actuator bar so as to provide a connection between the pedal lever and the actuating bar that is releasable by the action of a force occurring in an accident resulting in a deformation of a front part of an automotive vehicle, wherein the connection between the actuating bar and the bolt is released by the action of a force occurring in the direction of the bolt.

2. An arrangement according to claim 1, wherein the locking device is configured as a collar that embraces the actuating bar.

3. An arrangement according to claim 1, wherein the projections forming the first pair and second pair of opposing projections are resilient and adapted to engage an associated circumferential groove on the bolt.

4. An arrangement according to claim 1, wherein the locking device is integrally formed of sheet metal and preferably is provided with a holding arm which, in spaced relationship from the locking device, engages the actuating bar.

5. An arrangement according to claim 1, wherein the locking device is a plastic foil sleeve with an outer and an inner cylindrical surface.

6. An arrangement according to claim 1, further including at least one pair of spaced apart third projections supported by the planar body for engaging the actuator bar.

7. An arrangement according to claim 1, wherein the second pair of opposing projections comprises at least one spring element, the force of which will have to be overcome to safeguard a locking process.

8. An arrangement according to claim 7, wherein the bolt has a head and a basis and the at least one spring element is supported at at least one of the following locations: at the head of the bolt and at the pedal lever in the area of the bolt basis.

9. An arrangement according to claim 7, wherein the spring force of the at least one spring element is so selected that in the event of an incomplete engagement the locking device is held disengaged from the bolt.

10. An arrangement according to claim 9, wherein the bolt has a head and a basis and the at least one spring element is supported at at least one of the following locations: at the head of the bolt and at the pedal lever in the area of the bolt basis.

* * * * *